United States Patent [19]

Illustrato

[11] Patent Number: 4,638,575

[45] Date of Patent: Jan. 27, 1987

[54] SPRING HEEL FOR SHOE AND THE LIKE

[76] Inventor: Vito J. Illustrato, 928 Peace St., Pelham Manor, N.Y. 10803

[21] Appl. No.: 818,377

[22] Filed: Jan. 13, 1986

[51] Int. Cl.[4] ..... A43B 21/30; A43B 21/00

[52] U.S. Cl. ..... 36/38; 36/7.8; 36/28

[58] Field of Search ..... 36/7.8, 27, 28, 29, 36/38, 83, 102, 103, 105, 37; 272/114

[56] References Cited

U.S. PATENT DOCUMENTS

| | | | |
|---|---|---|---|
| 167,959 | 9/1875 | Vint | 36/38 |
| 832,987 | 10/1906 | Linwood et al. | 36/38 |
| 1,469,920 | 10/1923 | Dutchak | 36/38 |
| 1,551,245 | 8/1925 | Dohemann | 36/38 |
| 1,693,911 | 12/1928 | Schmeer | 36/28 |
| 2,078,551 | 4/1937 | Williams | 36/38 |
| 2,413,545 | 12/1946 | Cordi | 36/7.8 |
| 2,508,318 | 5/1950 | Wallach | 36/38 |
| 3,214,849 | 11/1965 | Nadaud | 36/37 |

FOREIGN PATENT DOCUMENTS

| | | | |
|---|---|---|---|
| 86281 | 10/1895 | Fed. Rep. of Germany | 36/38 |
| 246689 | 5/1911 | Fed. Rep. of Germany | 36/38 |
| 618719 | 8/1935 | Fed. Rep. of Germany | 36/38 |
| 281482 | 1/1931 | Italy | 36/28 |
| 506875 | 12/1954 | Italy | 36/28 |
| 17971 | 5/1902 | United Kingdom | 36/38 |

*Primary Examiner*—Henry S. Jaudon
*Assistant Examiner*—Steven N. Meyers
*Attorney, Agent, or Firm*—Richard L. Miller

[57] ABSTRACT

A shoe including a hollow chamber in its heel vented so to contract at each step and a curved steel leaf springs inside the chamber bearing between an upper inside and a bottom sole of the shoe heel, the springs extending forwardly-rearwardly.

3 Claims, 4 Drawing Figures

SPRING HEEL FOR SHOE AND THE LIKE

BACKGROUND OF THE INVENTION

This invention relates generally to footgear such as shoes of various kinds. More specifically it relates to a heel construction for being incorporated in the building of a shoe, and is an improvement over the existing art in this field.

It is well known that comfort in footwear is a prime concern to most persons and is of special importance to persons who must wear them for long hours or while under strenuous physical activity such as mail carriers, restaurant waiters or athletes such as runners or walkers. Such persons are well aware that their purchase of shoes must be done with careful selection in order to obtain a best for them. However, a careful study of heel design in shoes presently available, shows but little differences there between in construction, and it is not surprising that many of these people still keep hunting for a more ideally comfortable shoe than they now wear. It is believed that there is a need for a substantial change in shoe heel design so that there is a marked improvement in shoe comfort.

SUMMARY OF THE INVENTION

Accordingly it is a principal object of the present invention, to provide a shoe heel of new design that incorporates springs giving a "live" or active cushioning action throughout each step movement by a person so as to minimize the impact on the heel during running or walking, such as occurs with standard foam or soft rubber soles extended under the heel.

Another object is to provide a spring heel which could be incorporated into work shoes, dress shoes or sports shoes of various sizes and wherein a mechanical spring tension may be varied to accommodate persons of different weights.

Other objects are to provide a spring heel for shoes or the like, and which is simple in design, inexpensive to manufacture and long wearing in use.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF PREFERRED EMBODIMENT

Figure 1:
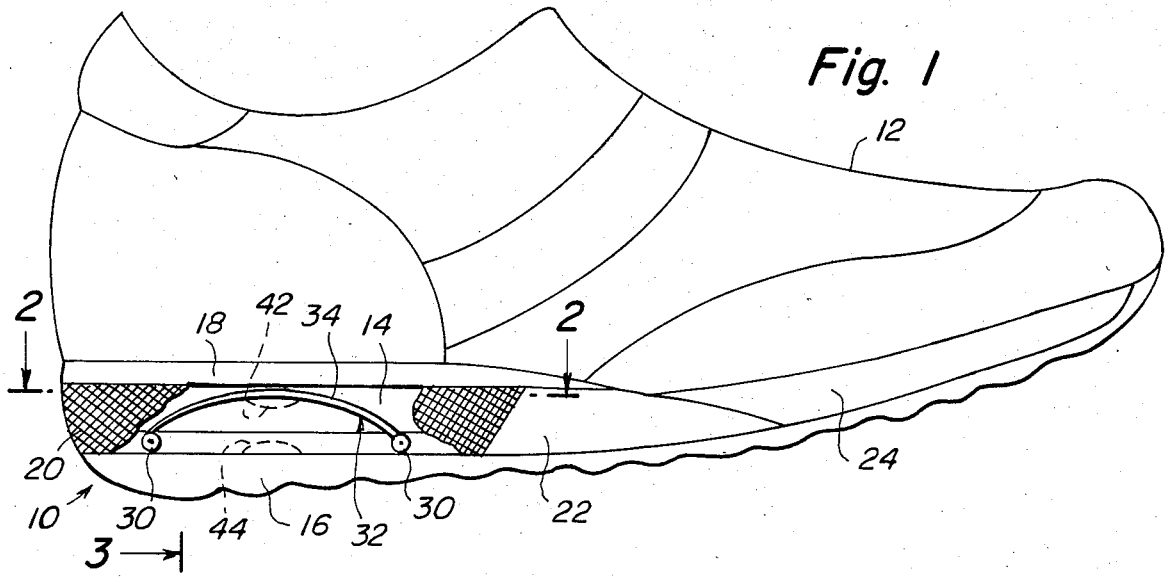
FIG. 1 is a side view of a shoe with parts broken away and with the invention incorporated therein.
Figure 2:
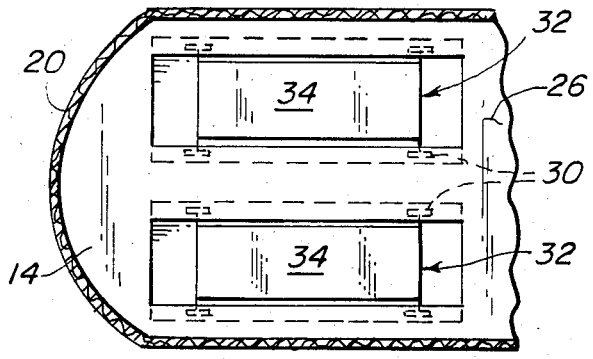
FIG. 2 is a cross sectional view taken on line 2—2 in FIG. 1.

Referring now to the Drawing in greater detail, the reference numeral 10 represents a spring heel for shoes 12 and the like wherein a hollow chamber 14 is formed between a rear position of a bottom sole 16 and insole 18 that extends to a forward end of the shoe. A canvas or other resilient material forms a vertical wall 20 around a rear and opposite sides of the chamber while a block 22 of soft foam material is located at a front end of the chamber and between the inside and bottom sole. If the shoe is an athletic or sports shoe, as shown in the drawing, a block 24 of more dense cushioning material is located forwardly of the foam block 22.

In the present invention, a block 26 preferably molded of a hard plastic or equivalent material is placed inside the chamber and rigidly affixed upon the bottom side; the block being molded with two sets of forwardly-rearwardly extending grooves 28 that serve as tracks inside which wheels 30 of a pair of cushioning mechanisms 32 can travel.

Figure 3:
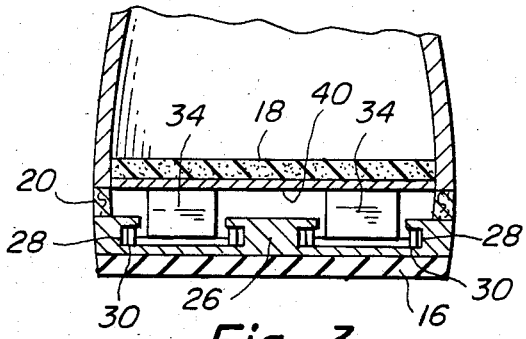
FIG. 3 is a cross sectional view taken on line 3—3 in FIG. 2.
Figure 4:
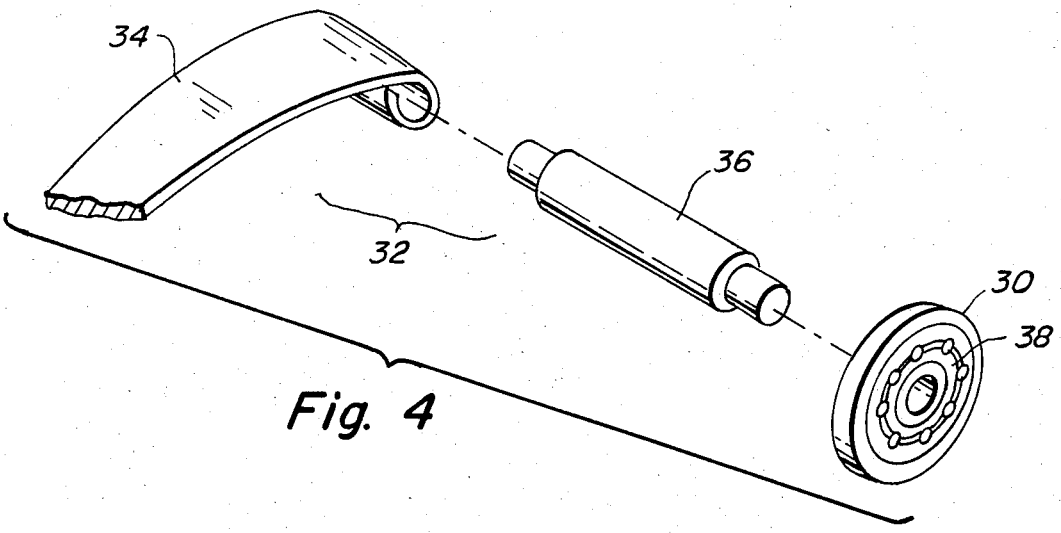
FIG. 4 is an enlarged exploded perspective view of the wheel assembly with parts broken away.

Each mechanism 32 comprises an elongated steel leaf spring 34 which at opposite ends is rolled around a shaft 36 having projecting opposite ends fitted either with ball bearings 38 and/or directly with the wheels 30. The leaf spring is normally upwardly curved so as to bear against an underside of the insole that may possibly be padded at this area by a pad 40 for this purpose, as shown in FIG. 3. Impact attenuators 42 and 44 may or may not be included in the construction, as shown by the phantom lines in FIG. 1. The upper attenuator 42 would serve for fastening the spring thereto and support from the inside.

In operative use, the spring heel cushions and/or minimizes impact on a person's heels while walking or running. Fresh air circulates through walls 20 which are made of a porous material into the chamber as a person takes each step; the side walls serving as air bellows for the moving air, and allowing the chamber to contact and expand with every step. The curved springs, bearing between the inside and bottom sole, thus are alternately flattened out and the wheels travel in the tracks.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A shoe incorporating a spring heel, comprising, in combination, a hollow chamber inside a heel of said shoe, a plurality of flexing leaf springs that bear between the inside bottom surface of the hollow chamber and a bottom surface of a sole of said shoe and is free to slidably move with respect to both said surfaces, the side walls of said chamber including flexible vent means for outside air to circulate into said chamber when said chamber alternately collapses and expands at each step by a person and weight application upon said heel, said leaf springs being upwardly curved and extending forwardly-rearwardly in said heel, and comprising wheel means at its distal end which roll in a track means contained within said chamber.

2. A shoe as in claim 1, and comprising a molded block fixed inside said hollow chamber, said block comprising two sets of forwardly-rearwardly extending grooves providing said tracks along which said wheels roll.

3. A shoe as in claim 2, wherein said leaf springs comprise rolled distal edges, a shaft passing within said rolled distal edges, and wherein said wheels are supported at the ends of said shaft.

* * * * *